US005754936A

United States Patent [19]

Jansson

[11] Patent Number: 5,754,936

[45] Date of Patent: May 19, 1998

[54] IRON POWDER COMPONENTS CONTAINING THERMOPLASTIC RESIN AND METHOD OF MAKING SAME

[75] Inventor: Patricia Jansson, Viken, Sweden

[73] Assignee: Höganäs AB, Höganäs, Sweden

[21] Appl. No.: 776,124

[22] PCT Filed: Jul. 17, 1995

[86] PCT No.: PCT/SE95/00874

§ 371 Date: Jan. 21, 1997

§ 102(e) Date: Jan. 21, 1997

[87] PCT Pub. No.: WO96/02345

PCT Pub. Date: Feb. 1, 1996

[30] Foreign Application Priority Data

Jul. 18, 1994 [SE] Sweden ..... 9402497

[51] Int. Cl.[6] ..... B22F 1/00

[52] U.S. Cl. ..... 419/10; 419/29; 419/35; 419/37

[58] Field of Search ..... 419/10, 29, 35, 419/37

[56] References Cited

U.S. PATENT DOCUMENTS 5,211,896 5/1993 Ward et al. .

5,268,140 12/1993 Rutz et al. .

5,563,001 10/1996 Gay .

FOREIGN PATENT DOCUMENTS 0 540 503 5/1993 European Pat. Off. .

3439397 4/1986 Germany .

4-349603 12/1992 Japan .

5-234728 9/1993 Japan .

765891 9/1980 U.S.S.R. .

*Primary Examiner*—Charles T. Jordan

*Assistant Examiner*—Anthony R. Chi

*Attorney, Agent, or Firm*—Burns, Doane, Swecker & Mathis, L.L.P.

[57] ABSTRACT

The present invention concerns a method, according to which powder compositions of iron-based particles are admixed with a thermoplastic material and a lubricant. The obtained mixture is compacted at a temperature below the glass-transition temperature or melting point of the thermoplastic resin and the compacted product is heated in order to cure the thermoplastic resin. Subsequently, the obtained compacted component is optionally heated to a temperature above the curing temperature.

20 Claims, 4 Drawing Sheets

Figure 1:
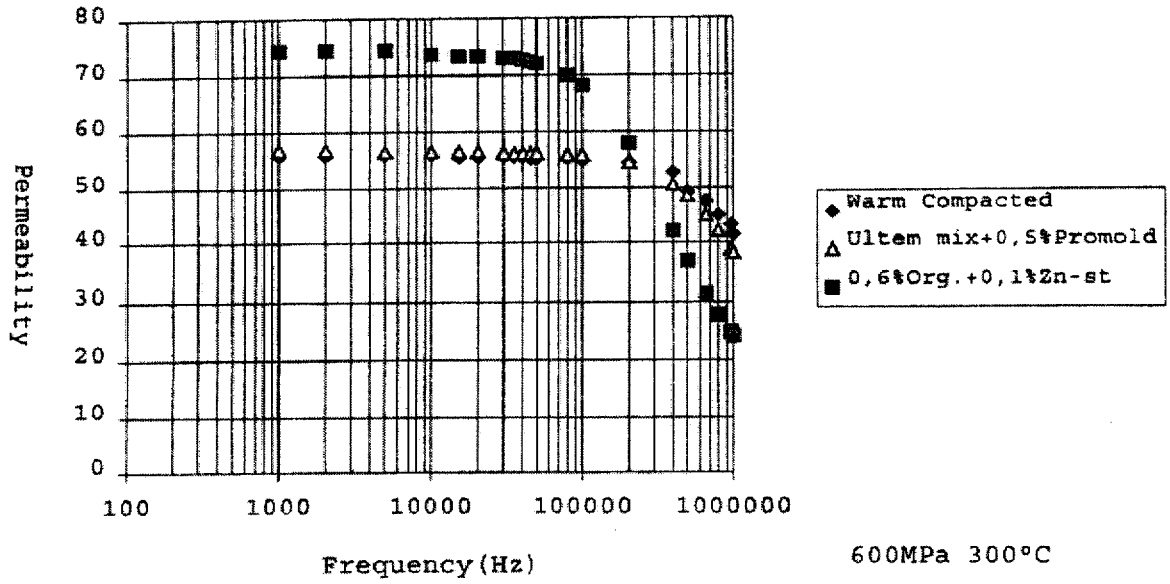

FIG.I Comparison of Cold Compacted Ultem Mix +0,5%Promold, 0,6% Orgasol+0,1%Zn-st. and Warm Compacted Double Coated Ultem Comparison of 0,5% Additions of Ultem and Lubricant by D.M. based on ABM100.32

The Effect of Compaction Temperature on 0,5% Additions of Ultem and Lubricant by D.M. based on ABM100.32

ABM100.32 with Ultem D.M. + Orgasol & 0,6% Orgasol both Warm & Cold Compacted Compared to the Referance containing 0,5% Kenolube

IRON POWDER COMPONENTS CONTAINING THERMOPLASTIC RESIN AND METHOD OF MAKING SAME

This invention relates to a process of heat treating compacted iron-based powder compositions. More particularly, the invention relates to a process, in which iron compositions are mixed with thermoplastic resins, compacted and heated. The process is particularly useful for making magnetic core components having good soft magnetic properties and high strength.

U.S. Pat. No. 5,268,140 discloses a method for producing a high-strength iron-based component by powder-metallurgical techniques. According to this method a powder composition of iron-based particles, which are coated or admixed with a thermoplastic material in the presence of an organic solvent, is compacted in a die at a temperature above the glass-transition temperature of the thermoplastic material and the obtained component is separately heated at a temperature that is at least as high as the compacting temperature up to about 800° F. (427° C.). The resulting component has increased strength and can be used as a structural component or as a magnetic core component. Furthermore, this patent discloses that, according to the most preferred embodiment, the thermoplastic material is present as a coating on the surfaces of the individual iron particles. In variations of this embodiment the iron particles can be double-coated such as where, in addition to an outer layer of the thermoplastic material, the particles have a first inner coating of an insulative material such as iron phosphate.

In brief, the present invention concerns a process, according to which powder compositions of iron-based particles are admixed with a thermoplastic material. The obtained mixture is compacted at a temperatue below the glass-transition temperature or melting point of the thermoplastic material and the compacted product is heated in order to cure the thermoplastic resin. Subsequently the obtained compacted component is optionally annealed to a temperature above the curing temperature.

Specifically, the invention concerns a process for powder-metallurgical preparation of products having high strength and improved soft-magnetic properties comprising the following steps a) treating particles of an atomised or sponge iron powder with phosphoric acid at a temperature and for a time sufficient to form an iron phosphate layer material, b) drying the obtained powder, c) mixing the dry powder with a dry powder of a thermoplastic resin selected from the group consisting of polyphenylene ethers and polyetherimides and oligomers of amide type, and with a low-melting lubricant to form a substantially homogeneous particle mixture, d) compacting the obtained powder mixture in a die at a temperature below the glass-transition temperature or melting point of the thermoplastic resin e) heating the compacted product to the curing temperature of the thermoplastic resin, and f) optionally annealing the obtained component to a temperature above the curing temperature of the thermoplastic resin.

In step a) of the process, particles of an atomised or sponge iron powder are preferably treated with an aqueous phosphoric acid solution to form an iron phosphate layer at the surface of the iron particles. The phosphoric acid treatment is carried out at room temperature and for a period of about 0.5 to about 2 hours. The water is then evaporated at a temperature of about 90° C. to about 100° C. in order to form a dry powder. According to another embodiment of the invention the iron powder is treated with phosphoric acid dissolved in an organic solvent.

The phosphorous layer should be as thin as possible and at the same time coating the separate particle as completely as possible. Thus the amount of phosphorus is higher for powders with a larger specific surface area. As sponge powders have a higher specific surface area than atomised powders the amount of P should generally be higher for sponge powders than for atomised powders. In the first case the P amount may vary between about 0.02 and 0.06, preferably between 0.03 and 0.05 whereas in latter case the P amount might vary between 0.005 and 0.04, preferably between 0.008 and 0.03% by weight of the powder.

The thermoplastic materials used in the process of the invention may be polymers having a weight average molecular weight in the range of about 10 000 to 50 000 and a level of crystallinity that allows them to be dissolved in an organic solvent. More specifically, the polymers are polyphenylene ethers, polyetherimides or any other of the polymers mentioned in U.S. Pat. No. 5,268,140 which is hereby incorporated by reference. A commercially available polyetherimide is sold under the trade name of ULTEM® resin. The most preferred ULTEM® resin is ULTEM® 1000 grade. Another thermoplastic material which can be used according to the invention is an oligomer of amide type having a weight molecular weight less than 30 000. Oligomers of this type are disclosed in PCT/SE95/00636 which is also incorporated by reference. Specific examples of oligomers are orgasols such as Orgasol 3501 and Orgasol 2001 available from Elf Atochem, France. These types of polymers are less amorphous,i.e. more crystalline than the polymers according to U.S. Pat. No. 5,268,140 and are not distinguished by glass-transitions temperatures but by melting points.

The particle size of the thermoplastic material is not critical. It is however preferred that the particle size is below about 100 μm. The amount of the thermoplastic material may vary between 0.1 and 1% by weight of the iron powder, preferably between 0.2 and 0.6% by weight.

In contrast to the process disclosed in the U.S. Pat. No. 5,268,140, it is mandatory to use a lubricant in the process according to the present invention.

Various lubricants can be used for mixing with the iron and thermoplastic particles. The lubricant, which preferably is of the low-melting type, may be selected from the group consisting of metal stearates, waxes, parafins, natural or synthetic fat derivates and oligomers of the amide type discussed above. Examples of commercially available lubricants which can be used in the process according to the invention are Kenolube® available from Höganäs AB Sweden, H-wax® available from Hoechst AG, Germany and Promold® available from Morton International of Cincinatti, Ihio. In this context it should be mentioned that the oligomers of amide type could be used either as thermoplastic resin or as lubricant or both. Thus, according to one embodiement of the invention, the insulated iron powder is mixed only with the oligomer in question, compacted at a temperature below the melting point of the oligomer, heated for curing the oligomer and optionally annealed.

The lubricants are used in amounts of 0.1 to 1%, preferably 0.2 to 0.8% by weight of the iron powder.

The powder composition of iron, thermoplastic resin and lubricant can be formed into molded components by an appropriate molding technique with a conventional die without any additional heating equipment as in the process according to the US patent. However, the mixture of iron powder, thermoplastic material and lubricant can also be preheated to a temperature below the glass-transition temperature or melting point of the thermoplastic resin before it is fed into the die which is also preheated to a temperature below the glass-transition temperature/melting point. According to a preferred embodiment, the powder composition can be formed into molded components by a cold compaction process, i.e. the compacting step is carried out at ambient temperature. The compacting step is carried out at a pressure between about 400 and 1800 MPa.

In the final, optional heat treatment or annealing step, the compacted and cured mixture is subjected to a temperature well above the curing temperature of the thermoplastic material. For the preferred thermoplastic materials according to the present invention, this involves heating to a temperature between about 100° and 600° C. Preferably the temperature varies between 200° and 500° C. and most preferably between 300° and 400° C. The heat treatment is preferably carried out in one separate step.

The main difference between the present process and the previously known process is that the process according to the present invention involves a compacting step which is carried out at at temperature below the glass-transition temperature or melting point of the thermoplastic resin. From this follows that the present process is less energy consuming and accordingly less expensive at the same time as, quite unexpectedly, essentially the same soft-magnetic properties can be obtained. Additionally, the use of lubricant in the powder mixture eliminates the need to lubricate the die which is necessary in the process according to the U.S. patent. Another advantage over the known process is that the present process can be carried out without the use of any environmentally detrimental organic solvents and in a conventional die.

The specific thermoplastic materials used according to the present invention eliminate the need of using alternating temperatures and pressures for obtaining the best results as is the case according to German Patent 34 39 397. This feature makes the present invention far more attractive from an industrial point of view than the process according to the German patent.

As regards the soft-magnetic properties it has been found that, at high frequency, the permeability versus frequency curves are essentially the same for products prepared according to the present invention as for the products prepared according to the known process. Also the strength of the materials is similar.

The invention is further illustrated by the following examples.

EXAMPLE 1

A mixture based on SCM100.28 (an iron powder available from Höganäs AB, Sweden) was treated with aqueous phosphoric acid and dried in order to provide a phosphorous coating on the iron particles. A total of 1% organic material composed of 0.5% Ultem®, particle size <70 μm and 0.5% Promold lubricant was dry-mixed to achieve a sample of a homogeneous material.

A mixture was based on ABM 100.32 (an iron powder available from Höganäs AB, Sweden) which has been treated with phosphoric acid and dried in order to provide a phosphorous coating on the iron particles. A total of 0.7% organic material composed of 0.6% Orgasol and 0.1% Zn-stearate lubricant was dry-mixed to achieve a sample of a homogeneous material.

An iron powder TC, prepared according to the U.S. Pat. No. 5,268,140 and marketed by Hoeganäs Corporation, Riverton N.J. as TC powder, was used as a reference sample. This sample was based on an iron powder with a phosphorous coating. An additional coating of Ultem® 1000 had been provided on the phosphate-insulated iron particles. (1% of the Ultem polymer was dissolved in an organic solvent and mixed with the phosphate-insulated iron particles. The solvent was then evaporated.)

All the samples were compacted at 600 MPa. The products according to this invention, i.e. the products containing Ultem® and Promold® and Orgasol® and zinc stearate, respectively, were compacted at ambient temperature in a conventional press. The twin-coated or double-coated powder according to the known process was pre-heated to a temperature of 150° C., and compacted in a die heated to 218° C., which is just above the glass-transition temperature of Ultem® 1000. All three samples were subsequently annealed at a temperature of 300° C. The magnetic properties are essentially the same for the cold-compacted product comprising Ultem® and Promold® according to the present invention as for the warm-compacted known product based on the double- or twin-coated product. The product based on Orgasol® and zinc stearate has a somewhat different profile with higher permeability at low frequencies and lower permeability at higher frequencies as shown by the permeabiliy versus frequency curves of FIG. 1.

EXAMPLE 2.

The mixture is based on ABM 100.32 (an iron powder available from Höganäs AB, Sweden), which has been treated with phosphoric acid and dried in order to provide a phosphorous coating on the iron particles. A total of 1% organic material composed of 0.5% Ultem® and 0.5% Orgasol® lubicant was dry mixed to achieve a sample of a homogeneous material.

A mixture treated with phosphoric acid as above and based on ABM 100.32 with 0.5% Ultem® and 0.5% Kenolube® lubricant was dry mixed to achieve a sample of a homogeneous material.

A mixture treated with phosphoric acid as above and based on ABM 100.32 with 0.6% Orgasol® as both lubricant and thermoplastic resin was dry mixed to achieve a sample of a homogeneous material.

The samples were compared after compacting at 600 MPa and ambient temperature followed by heat treatment at 300° C. for 60 minuted in air. The strength is compared in Table 1.

TABLE 1

| Material 300° C. 60 minutes air | Density 600 MPa | Green strength 600 MPa |
|---|---|---|
| ABM 100.32 + 0.5% Ultem(D.M.) + 0.5% Kenolube | 6.83 g/cm$^3$ | 80 N/mm$^2$ |
| ABM 100.32 + 0.5% Ultem(D.M.) + 0.5% Orgasol | 6.89 g/cm$^3$ | 108 N/mm$^2$ |
| ABM 100.32 + 0.6% Orgasol | 7.15 g/cm$^3$ | 107 N/mm$^2$ |

Figure 2:
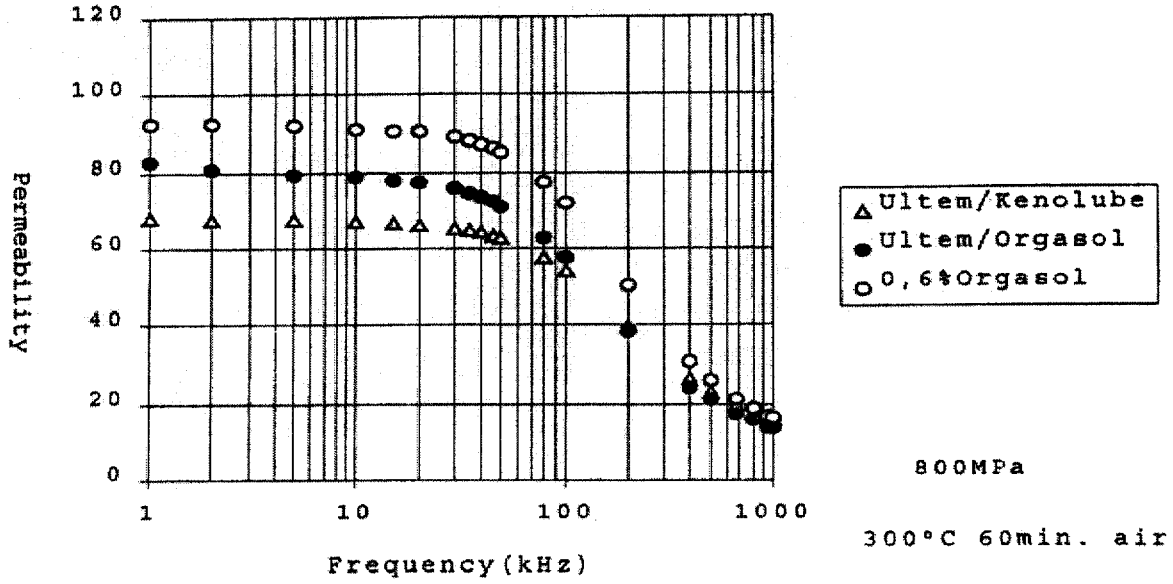

The samples were compared after compacting at 800 MPa and ambient temperature followed by heat treatment at 300° C. for 60 minutes in air. The permability versus frequency is disclosed in FIG. 2.

EXAMPLE 3

The mixture was based on ABM 100.32 (an iron powder available from Höganäs AB, Sweden) which has been treated with phosphoric acid and dried in order to provide a phosphorous coating on the iron particles). A total of 1% organic material composed of 0.5% Ultem and 0.5% Orgasol lubricant was dry mixed to achieve a sample of a homogeneous material.

A mix based on ABM 100.32 with 0.6% Orgasol as both lubricant and thermoplastic was dry mixed to achieve a sample of a homogeneous material.

Figure 3:
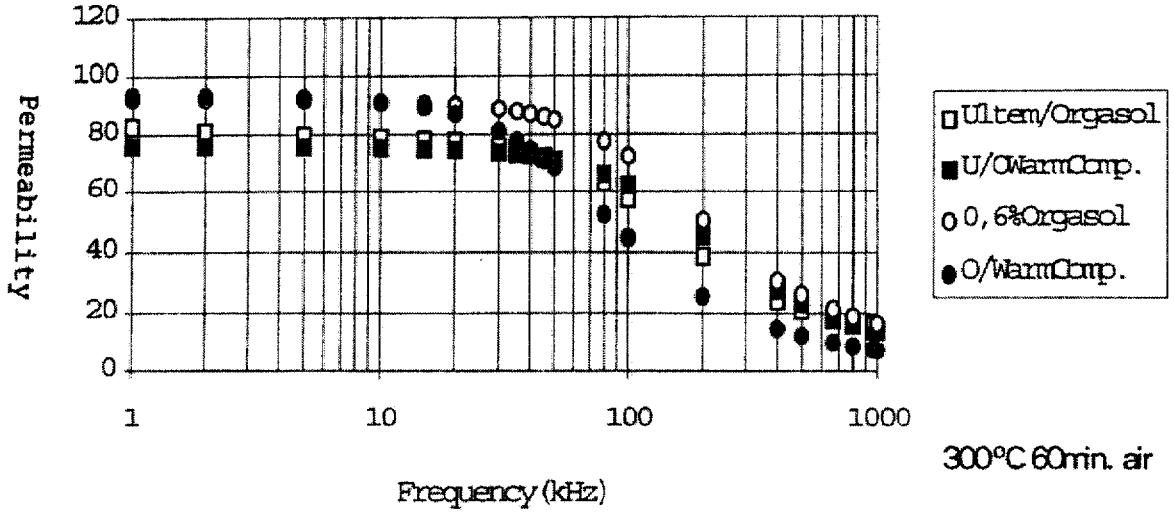
Figure 4:
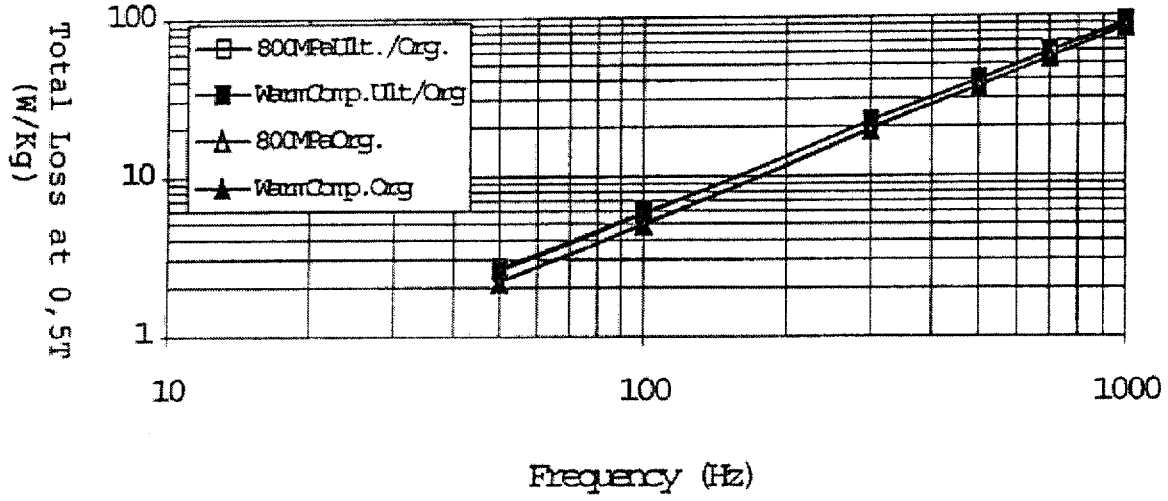

The effect of warm compaction at approximately 600 MPa compared to ambient temperature compaction at 800 MPa is shown in FIG. 3 and 4. The temperature for warm-compaction is powder temperature 110° C.–115° C. and the cooling temperature 130° C. for both samples. This is below the glass-transition temperature (Tg) for Ultem. In the case of Orgasol, the temperature is below the melting point (Tm).

I claim:

1. A process for powder-metallurgical preparation of products having high tensile strength and improved soft-magnetic properties comprising the following steps a) treating particles of an atomised or sponge iron powder with phosphoric acid at a temperature and for a time sufficient to form an iron phosphate layer material, b) drying the obtained powder, c) mixing the dry powder with a dry powder of a thermoplastic resin selected from the group consisting of polyphenylene ethers and polyetherimides and oligomers of amide type, and with a low-melting lubricant to form a substantially homogenous particle mixture, d) compacting the obtained powder mixture in a die at a temperature below the glass-transition temperature or melting point of the thermoplastic resin e) heating the compacted product in order to cure the thermoplastic resin, and f) optionally annealing the obtained component to a temperature above the curing temperature of the thermoplastic resin.

2. Process according to claim 1, characterised in that the lubricant is selected from the group consisting of stearates, waxes, parafins, natural and synthetic fat derivatives and oligomers of polyamide type.

3. Process according to claim 1, characterised in that the particles of the atomised or sponge iron powder are treated with aqueous phosphoric acid.

4. Process according to claim 1 characterised in that the resin is added in an amount of 0.1 to 2% by weight of the iron powder, preferably below 1.5%.

5. Process according to claim 1 characterised in that the thermoplastic resin has a particle size below 200 μm, preferably below 100 μm.

6. Process according to claim 1 characterised in that the temperature of step f) varies between 1000° and 600° C.

7. Process according to claim 6, characterised in that the temperature varies between 200° and 500° C., preferably between 300° and 400° C.

8. Process according to claim 2, characterised in that the compacting is carried out at ambient temperature.

9. Process according to claim 1 characterised in that the thermoplastic resin and the low-melting lubricant is an oligomer of amide type.

10. Process according to claim 2, characterised in that the particles of the atomised or sponge iron powder are treated with aqueous phosphoric acid.

11. Process according to claim 2, characterised in that the resin is added in an amount of 0.1 to 2% by weight of the iron powder, preferably below 1.5%.

12. Process according to claim 3, characterised in that the resin is added in an amount of 0.1 to 2% by weight of the iron powder, preferably below 1.5% .

13. Process according to claim 4, characterised in that the thermoplastic resin has a particle size below 200 μm, preferably below 100 μm.

14. Process according to claim 2, characterised in that the temperature of step f) varies between 100° and 600° C.

15. Process according to claim 3, characterised in that the temperature of step f) varies between 100° and 600° C.

16. Process according to claim 4, characterised in that the temperature of step f) varies between 100° and 600° C.

17. Process according to claim 3, characterised in that the compacting is carried out at ambient temperature.

18. Process according to claim 4, characterised in that the compacting is carried out at ambient temperature.

19. Process according to claim 2, characterised in that the thermoplastic resin and the low-melting lubricant is an oligomer of amide type.

20. Process according to claim 3, characterised in that the thermoplastic resin and the low-melting lubricant is an oligomer of amide type.

* * * * *